US006550712B1

(12) United States Patent
Peterpaul

(10) Patent No.: US 6,550,712 B1
(45) Date of Patent: Apr. 22, 2003

(54) SPOOL WINDING DEVICE

(76) Inventor: James A. Peterpaul, 47 Gridley Cir., Milford, NJ (US) 08848

( * ) Notice: Subject to any disclaimer, the term of this patent is extended or adjusted under 35 U.S.C. 154(b) by 0 days.

(21) Appl. No.: 09/904,726

(22) Filed: Jul. 13, 2001

(51) Int. Cl.[7] ..... B65H 75/30; B65H 75/40

(52) U.S. Cl. ..... 242/390.8; 242/394; 242/405.3; 244/155 A

(58) Field of Search ..... 242/390.8, 390.9, 242/405.3, 394, 250, 323; D8/359; 244/155 A

(56) References Cited

U.S. PATENT DOCUMENTS 3,126,166 A * 3/1964 Weinberg ..... 242/250
3,202,378 A 8/1965 Williamson
3,593,940 A 7/1971 Stanton
3,964,425 A * 6/1976 Septor ..... 242/390.8
4,915,320 A 4/1990 Neal
4,951,890 A * 8/1990 Sossamon ..... 242/390.8
4,962,901 A * 10/1990 Shirley et al. ..... 242/250
D326,048 S 5/1992 Adler
5,190,237 A 3/1993 Fagan
5,277,350 A 1/1994 Thornbury
6,015,111 A * 1/2000 Berke ..... 242/390.8
6,129,391 A * 2/2000 Holley et al. ..... 242/390.8

* cited by examiner

*Primary Examiner*—John M. Jillions

(57) ABSTRACT

A spool winding device for winding up a flexible line about a spool such as that used in kite flying. The spool winding device includes a sleeve member being adapted to be removably and engagably disposed about a handle member of a spool; and further includes a tool attachment member being removably and fastenably disposed about the sleeve member and being attachable to a power tool.

4 Claims, 2 Drawing Sheets

SPOOL WINDING DEVICE

BACKGROUND OF THE INVENTION

1. Field of the Invention

The present invention relates to spool winding kits and more particularly pertains to a new spool winding device for winding up a flexible line about a spool such as that used in kite flying.

2. Description of the Prior Art

The use of spool winding kits is known in the prior art. More specifically, spool winding kits heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,190,237; U.S. Pat. No. 4,915,320; U.S. Pat. No. 5,277,350; U.S. Pat. No. 3,593,940; U.S. Pat. No. 3,202,378; and U.S. Pat. No. Des. 326,048.

While these devices fulfill their respective, particular objectives and requirements, the aforementioned patents do not disclose a new spool winding device. The inventive device includes a sleeve member being adapted to be removably and engagably disposed about a handle member of a spool; and further includes a tool attachment member being removably and fastenably disposed about the sleeve member and being attachable to a power tool.

In these respects, the spool winding device according to the present invention substantially departs from the conventional concepts and designs of the prior art, and in so doing provides an apparatus primarily developed for the purpose of winding up a flexible line about a spool such as that used in kite flying.

SUMMARY OF THE INVENTION

In view of the foregoing disadvantages inherent in the known types of spool winding kits now present in the prior art, the present invention provides a new spool winding device construction wherein the same can be utilized for winding up a flexible line about a spool such as that used in kite flying.

The general purpose of the present invention, which will be described subsequently in greater detail, is to provide a new spool winding device which has many of the advantages of the spool winding kits mentioned heretofore and many novel features that result in a new spool winding device which is not anticipated, rendered obvious, suggested, or even implied by any of the prior art spool winding kits, either alone or in any combination thereof.

To attain this, the present invention generally comprises a sleeve member being adapted to be removably and engagably disposed about a handle member of a spool; and further includes a tool attachment member being removably and fastenably disposed about the sleeve member and being attachable to a power tool.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new spool winding device which has many of the advantages of the spool winding kits mentioned heretofore and many novel features that result in a new spool winding device which is not anticipated, rendered obvious, suggested, or even implied by any of the prior art spool winding kits, either alone or in any combination thereof.

It is another object of the present invention to provide a new spool winding device which may be easily and efficiently manufactured and marketed.

It is a further object of the present invention to provide a new spool winding device which is of a durable and reliable construction.

An even further object of the present invention is to provide a new spool winding device which is susceptible of a low cost of manufacture with regard to both materials and labor, and which accordingly is then susceptible of low prices of sale to the consuming public, thereby making such spool winding device economically available to the buying public.

Still yet another object of the present invention is to provide a new spool winding device which provides in the apparatuses and methods of the prior art some of the advantages thereof, while simultaneously overcoming some of the disadvantages normally associated therewith.

Still another object of the present invention is to provide a new spool winding device for winding up a flexible line about a spool such as that used in kite flying.

Yet another object of the present invention is to provide a new spool winding device which includes a sleeve member being adapted to be removably and engagably disposed about a handle member of a spool; and further includes a tool attachment member being removably and fastenably disposed about the sleeve member and being attachable to a power tool.

Still yet another object of the present invention is to provide a new spool winding device that is easy and convenient to use.

Even still another object of the present invention is to provide a new spool winding device that allows the user to quickly wind up and control the flexible line for a kite, in particular.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
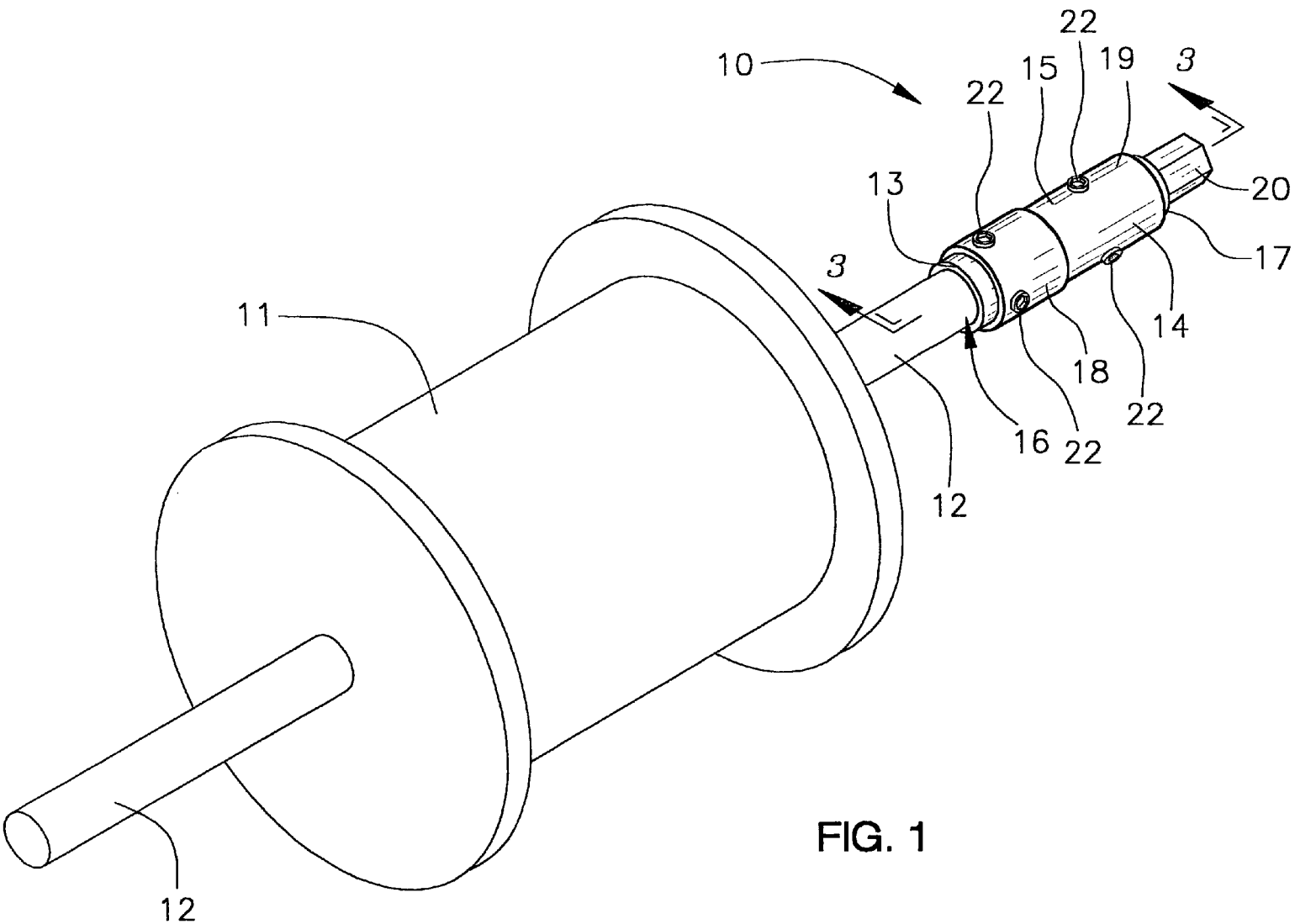
FIG. 1 is a perspective view of a new spool winding device according to the present invention.
Figure 2:
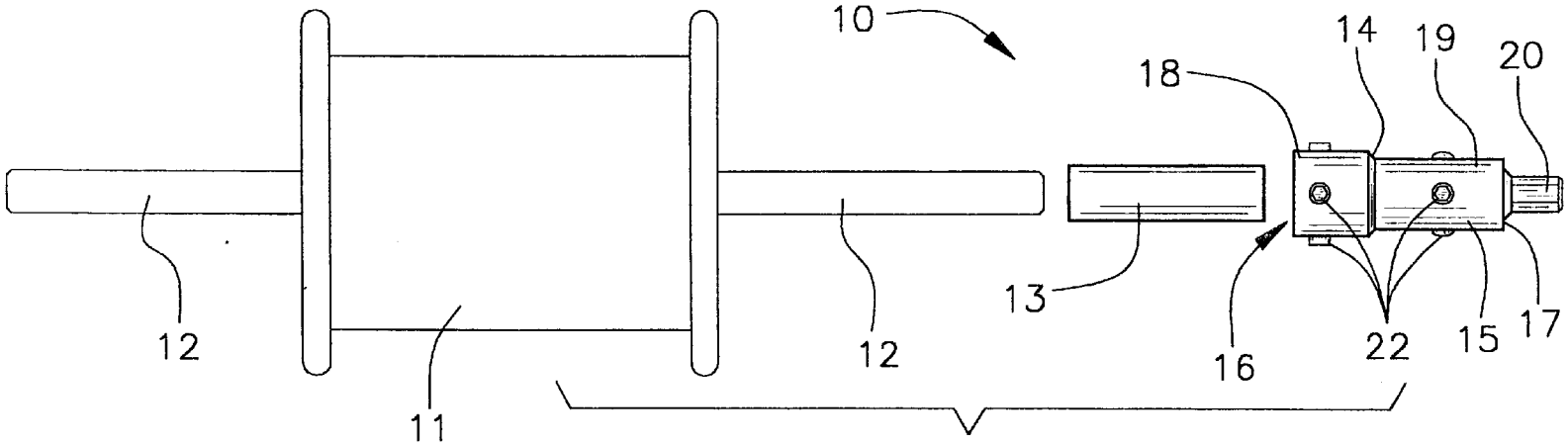
FIG. 2 is an exploded side elevational view of the present invention.
Figure 3:
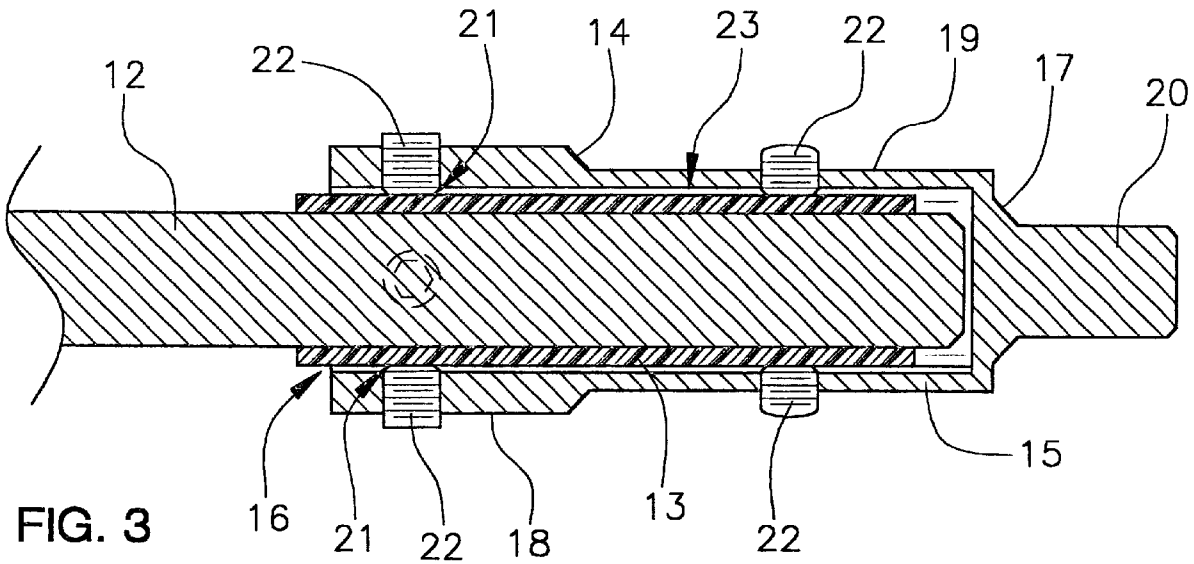
FIG. 3 is a partial cross-sectional view of the present invention.

With reference now to the drawings, and in particular to FIGS. 1 through 3 thereof, a new spool winding device embodying the principles and concepts of the present invention and generally designated by the reference numeral 10 will be described.

As best illustrated in FIGS. 1 through 3, the spool winding device 10 generally comprises a sleeve member 13 being adapted to be removably and engagably disposed about a handle member 12 of a spool 11. A tool attachment member 14 is removably and fastenably disposed about the sleeve member 13 and is attachable to a power tool. The tool attachment member 14 includes a tubular member 15 having an open first end 16 and a closed second end 17 and a bore 23 extending therein through the open first end 16, and also includes a multi-sided stub shaft 20 being conventionally attached to the closed second end 17 and extending outwardly therefrom and being adapted to attach to a power tool such as a drill, and further includes a plurality of fastening members 22 for securely fastening the tubular member 14 to the sleeve member 13. The tubular member 11 has an enlarged first end portion 18 and a second end portion 19 to which the multi-sided stub shaft 20 is conventionally attached. The tubular member 14 has a plurality of holes 21 being disposed through a side wall thereof and into the bore,23. The fastening members 22 are threaded in the holes 21 and are engagable to the sleeve member 13.

In use, the user places the sleeve member 13 about a handle member 12 of the spool 11, and then slides the open first end 16 of the tubular member 15 about the sleeve member 13 with the sleeve member 13 being received in he bore 23. The user then threads the fastening members 22 through the holes 21 in the tubular member 15 to fasten the tool attachment member 14 and the sleeve member 13 to the particular handle member 12. Next, the user attaches a power tool to the stub shaft 20 to rotate the spool 11 to take up the flexible line.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spool winding device comprising:

a sleeve member being adapted to be removably and engagably disposed about a handle member of a spool;

a tool attachment member being removably and fastenably disposed about said sleeve member and being attachable to a power tool;

wherein said tool attachment member includes a tubular member having an open first end and a closed second end and a bore extending therein through said open first end and removably receiving said sleeve member and also includes a multi-sided stub shaft being attached to said closed second end and extending outwardly therefrom and being adapted to attach to a power tool such as a drill, and further includes a plurality of fastening members for securely fastening said tubular member to said sleeve member.

2. A spool winding device as described in claim 1, wherein said tubular member has an enlarged first end portion and a second end portion to which said multi-sided stub shaft is attached.

3. A spool winding device as described in claim 2, wherein said tubular member has a plurality of holes being disposed through a side wall thereof and into said bore, said fastening members being threaded in said holes and being engagable to said sleeve member.

4. A spool winding device comprising:

a sleeve member being adapted to be removably and engagably disposed about a handle member of a spool; and a tool attachment member being removably and fastenably disposed about said sleeve member and being attachable to a power tool, said tool attachment member including a tubular member having an open first end and a closed second end and a bore extending therein through said open first end and removably receiving said sleeve member, and also including a multi-sided stub shaft being attached to said closed second end and extending outwardly therefrom and being adapted to attach to a power tool such as a drill, and further including a plurality of fastening members for securely fastening said tubular member to said sleeve member, said tubular member having an enlarged first end portion and a second end portion to which said multi-sided stub shaft is attached, said tubular member having a plurality of holes being disposed through a side wall thereof and into said bore, said fastening members being threaded in said holes and being engagable to said sleeve member.

* * * * *